US009066563B2

(12) United States Patent
Chan

(10) Patent No.: US 9,066,563 B2
(45) Date of Patent: Jun. 30, 2015

(54) LINK ASSEMBLY AND A BRACELET WITH SUCH AN ASSEMBLY

(71) Applicant: Chung Nam Watch Company Limited, Hong Kong (HK)

(72) Inventor: Siu Ming Raymond Chan, Hong Kong (HK)

(73) Assignee: CHUNG NAM WATCH COMPANY LIMITED, Hong Kong (HK)

( * ) Notice: Subject to any disclaimer, the term of this patent is extended or adjusted under 35 U.S.C. 154(b) by 7 days.

(21) Appl. No.: 14/180,549

(22) Filed: Feb. 14, 2014

(65) Prior Publication Data

US 2015/0107300 A1 Apr. 23, 2015

(30) Foreign Application Priority Data

Oct. 18, 2013 (HK) ..... 13111748.7

(51) Int. Cl.
*A44C 5/02* (2006.01)
*G04B 37/16* (2006.01)

(52) U.S. Cl.
CPC .. *A44C 5/02* (2013.01); *G04B 37/16* (2013.01)

(58) Field of Classification Search
CPC ..... G04B 37/16; A44C 5/02
USPC ..... 59/80
See application file for complete search history.

(56) References Cited

U.S. PATENT DOCUMENTS

| | | | | |
|---|---|---|---|---|
| 5,483,505 | A * | 1/1996 | Cartier | 368/282 |
| 6,237,319 | B1 * | 5/2001 | Amundsen et al. | 59/82 |
| 6,272,836 | B1 * | 8/2001 | Fat | 59/80 |
| 8,240,011 | B2 * | 8/2012 | Chevrolet | 24/265 B |
| 8,567,172 | B2 * | 10/2013 | Asami | 59/80 |

FOREIGN PATENT DOCUMENTS

| | | | |
|---|---|---|---|
| JP | H11-253214 | A | 9/1999 |
| JP | 2005224382 | A | 8/2005 |
| JP | 2010264203 | A | 11/2010 |

* cited by examiner

*Primary Examiner* — David B Jones
(74) *Attorney, Agent, or Firm* — Ware, Fressola, Maguire & Barber, LLP

(57) ABSTRACT

A link assembly has a first link with an inner major surface and an opposite outer major surface, and a second link releasably engageable with the first link. The first link has two locking pins and two control pins, movable simultaneously with each other. When the first link engages the second link, the control pins move between locking and unlocked positions. When the control pins are in the locking positions, part of each locking pin is received within a respective hole of the second link to prevent disengagement of the first link from the second link. When the control pins are in the unlocked positions, the locking pins are clear of the holes to disengage the first link from the second link. Each control pin extends through a respective opening of the first link inner major surface. A spring biases the locking pins away from each other.

14 Claims, 4 Drawing Sheets

LINK ASSEMBLY AND A BRACELET WITH SUCH AN ASSEMBLY

CROSS REFERENCE TO RELATED APPLICATIONS

This application claims priority in Hong Kong patent application no. 13111748.7, filed 18 Oct. 2013, the contents of which are hereby incorporated by reference.

TECHNICAL FIELD

This invention relates to a link assembly and, in particular, such an assembly with releasably detachable link members, and a bracelet with such a link assembly.

BACKGROUND

Bracelets are commonly worn, e.g. for ornamental purpose or as part of another wearable article, such as wristwatch. It is well known that wearers have different wrist sizes, and thus bracelets of one size do not fit all. To address this problem, manufacturers of such bracelets or wearable articles (e.g. wristwatches) with such bracelets usually provide longer bracelets, and supply special tools to retail outlets of such bracelets or wearable articles to allow the salespersons to adjust (usually shorten) the bracelets to fit the wrist size of the specific customer.

However, there still exists a need for a mechanism which allows an end user to easily adjust (lengthen or shorten) the length of a bracelet, e.g. if a certain bracelet or wearable article is bought as a present, or if the wrist size of the wearer changes over time.

SUMMARY OF THE INVENTION

It is thus an object of the present invention to provide a link assembly, a bracelet with such a link assembly, and a wearable article with such a bracelet, in which the aforesaid shortcomings are mitigated or at least to provide a useful alternative to the trade and public.

According to a first aspect of the present invention, there is provided a link assembly including a first link member with a first major surface and an opposite second major surface, and a second link member releasably engageable with said first link member, wherein said first link member includes at least a first locking member and a second locking member and at least a first control member and a second control member, wherein the first locking member and the first control member are movable simultaneously with each other, wherein the second locking member and the second control member are movable simultaneously with each other, wherein said second link member includes at least a first hole and a second hole, wherein when said first link member is engaged with said second link member, each of said first control member and second control member is movable between a respective locking position and a respective unlocked position, wherein when said first control member and said second control member are in their respective locking position, at least part of said first locking member is received within said first hole of said second link member and at least part of said second locking member is received within said second hole of said second link member to prevent disengagement of said first link member from said second link member, wherein when said first control member and said second control member are in their respective unlocked position, said first locking member is clear of said first hole of said second link member and said second locking member is clear of said second hole of said second link member to allow disengagement of said first link member from said second link member, wherein each of said first control member and said second control member extends through a respective opening of said first major surface of said first link member, and wherein a biasing element is positioned between said first locking member and said second locking member and biases said first locking member and said second locking member away from each other.

According to a second aspect of the present invention, there is provided a bracelet including a link assembly, said link assembly including a first link member with a first major surface and an opposite second major surface, and a second link member releasably engageable with said first link member, wherein said first link member includes at least a first locking member and a second locking member and at least a first control member and a second control member, wherein the first locking member and the first control member are movable simultaneously with each other, wherein the second locking member and the second control member are movable simultaneously with each other, wherein said second link member includes at least a first hole and a second hole, wherein when said first link member is engaged with said second link member, each of said first control member and second control member is movable between a respective locking position and a respective unlocked position, wherein when said first control member and said second control member are in their respective locking position, at least part of said first locking member is received within said first hole of said second link member and at least part of said second locking member is received within said second hole of said second link member to prevent disengagement of said first link member from said second link member, wherein when said first control member and said second control member are in their respective unlocked position, said first locking member is clear of said first hole of said second link member and said second locking member is clear of said second hole of said second link member to allow disengagement of said first link member from said second link member, wherein each of said first control member and said second control member extends through a respective opening of said first major surface of said first link member, and wherein a biasing element is positioned between said first locking member and said second locking member and biases said first locking member and said second locking member away from each other.

According to a third aspect of the present invention, there is provided a wearable article including a bracelet with a link assembly, said link assembly including a first link member with a first major surface and an opposite second major surface, and a second link member releasably engageable with said first link member, wherein said first link member includes at least a first locking member and a second locking member and at least a first control member and a second control member, wherein the first locking member and the first control member are movable simultaneously with each other, wherein the second locking member and the second control member are movable simultaneously with each other, wherein said second link member includes at least a first hole and a second hole, wherein when said first link member is engaged with said second link member, each of said first control member and second control member is movable between a respective locking position and a respective unlocked position, wherein when said first control member and said second control member are in their respective locking position, at least part of said first locking member is received within said first hole of said second link member and at least part of said second locking member is received within said second hole of said second link member to prevent disengagement of said first link member from said second link member, wherein when said first control member and said second control member are in their respective unlocked position, said first locking member is clear of said first hole of said second link member and said second locking member is clear of said second hole of said second link member to allow disengagement of said first link member from said second link member, wherein each of said first control member and said second control member extends through a respective opening of said first major surface of said first link member, and wherein a biasing element is positioned between said first locking member and said second locking member and biases said first locking member and said second locking member away from each other.

BRIEF DESCRIPTION OF THE DRAWINGS

A link assembly according to an embodiment of the present invention will now be described, by way of an example only, with reference to the accompany drawings, in which.

DETAILED DESCRIPTION OF THE INVENTION

Figure 2:
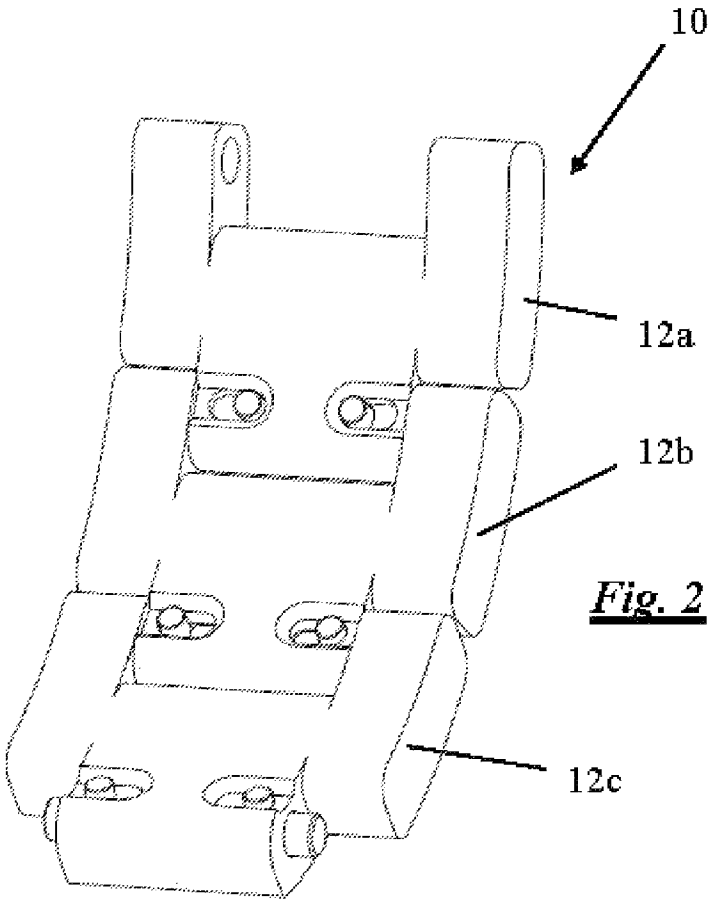
FIG. 2 is a further perspective view of the link assembly of FIG. 1, with the control pins in an unlocked position.
Figure 1:
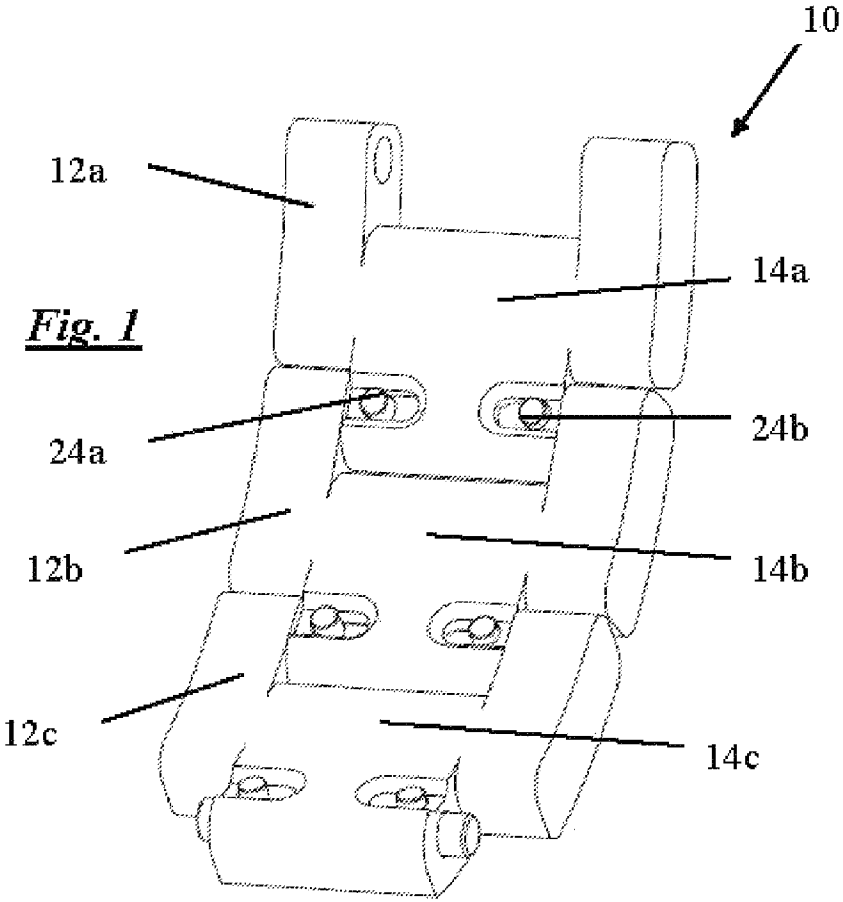
FIG. 1 is a perspective view of a link assembly according to an embodiment of the present invention, with control pins in a locking position.

A link assembly according to an embodiment of the present invention is shown in FIGS. 1 to 4, and generally designated as 10. The link assembly 10 is made up of three identically structured inter-engageable links 12*a*, 12*b*, 12*c*. As shown in FIGS. 1 and 2, the link 12*a* is directly releasably engaged with the link 12*b*, and the link 12*b* is directly releasably engaged with the link 12*c*. Each of the links 12*a*, 12*b*, 12*c* has an inner concave major surface 14*a*, 14*b*, 14*c* and an opposite outer convex major surface (not shown). The inner major surfaces 14*a*, 14*b*, 14*c* are intended, when in use, to contact the wearer.

Figure 4:
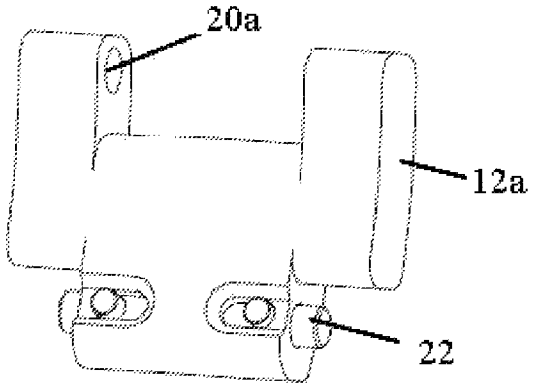
FIG. 4 is a further perspective view showing one link member of the link assembly of FIG. 1 detached from the remaining link assembly, with the control pins in the locking position.
Figure 4:
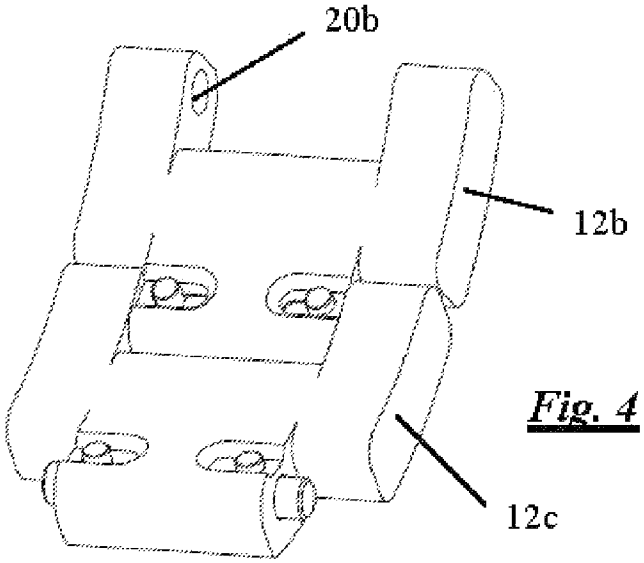
Figure 3:
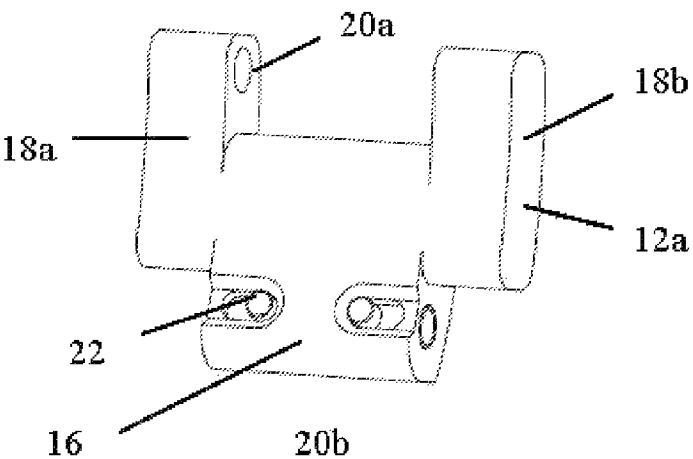
FIG. 3 is a further perspective view showing one link member of the link assembly of FIG. 1 detached from the remaining link assembly, with the control pins in the unlocked position.
Figure 3:
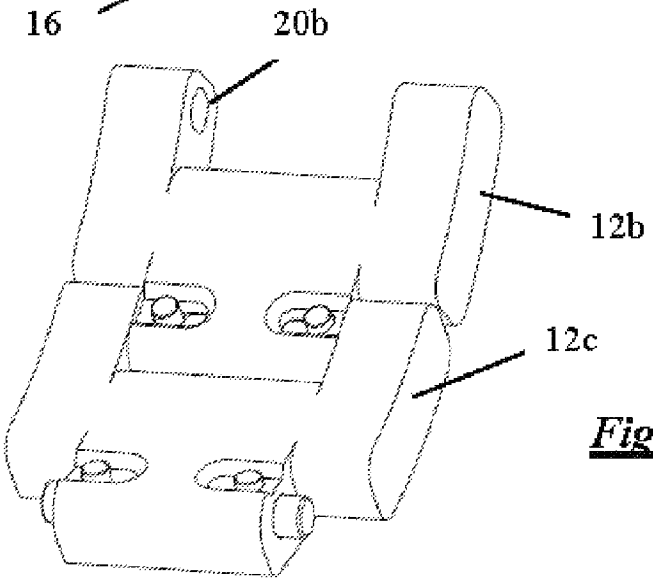

Taking the link 12*a* as an example, and referring to FIGS. 3 and 4, such includes a central body portion 16 and two leg portions 18*a*, 18*b* which are integrally joined with one another. Each of the leg portions 18*a*, 18*b* has a hole 20*a* (of which only one is shown in FIGS. 3 and 4). The hole 20*a* of the leg portion 18*a* faces the hole of the leg portion 18*b*. The two holes 20*a* are of the same diameter and same depth into the respective leg portions 18*a*, 18*b*, and their longitudinal axes lie on a same straight line.

Figure 5:
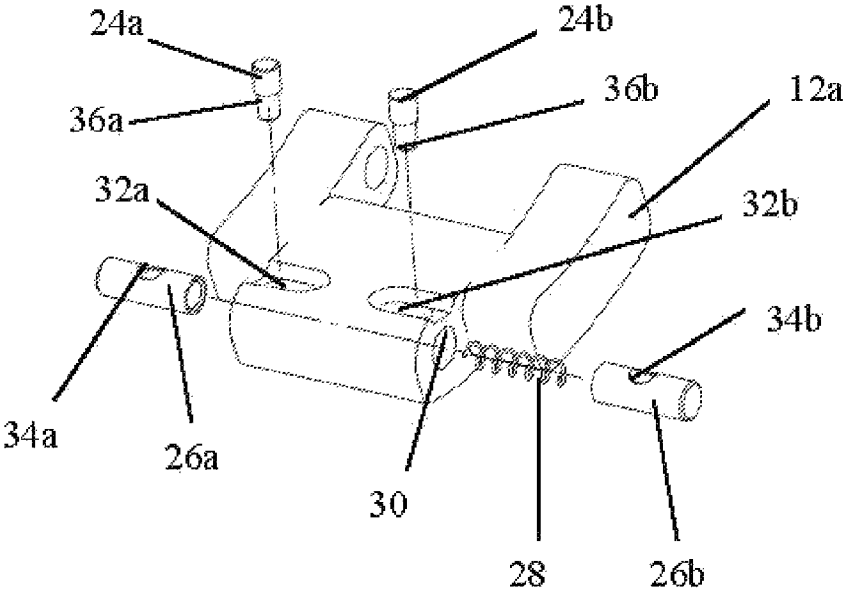
FIG. 5 is a perspective exploded view of the one of the link members of FIG. 1.

The central body portion 16 of the link 12*a* carries a locking mechanism 22. As shown more clearly in FIGS. 5 to 7, the locking mechanism 22 includes two control pins 24*a*, 24*b*, two locking pins 26*a*, 26*b*, and a biasing element comprising an elongate spring 28 with two opposite longitudinal ends. The link 12*a* includes a transverse through hole 30 receiving the two locking pins 26*a*, 26*b* and the spring 28, with the spring 28 positioned between and contacting the locking pins 26*a*, 26*b*. In particular, each longitudinal end of the spring 28 is received within a recess of a respective of the locking pins 26*a*, 26*b*.

Two elongate openings 32*a*, 32*b* are formed through the inner major surface 14*a* of the link 12*a*, communicating with the through hole 30. It is thus possible to access the through hole 30 through the openings 32*a*, 32*b*. Each of the locking pins 26*a*, 26*b* has a respective orifice 34*a*, 34*b*, each for receiving a lower engagement portion 36*a*, 36*b* of the respective control pins 24*a*, 24*b*, so as to fix the control pin 24*a* with the locking pin 26*a* for simultaneous movement and to fix the control pin 24*b* with the locking pin 26*b* for simultaneous movement.

Figure 6:
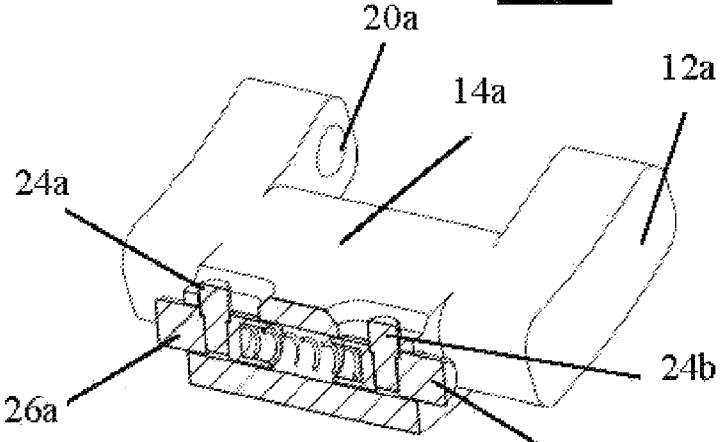
FIG. 6 is a partially sectioned view of the link member of FIG. 5 with the control pins in the locking position.
Figure 7:
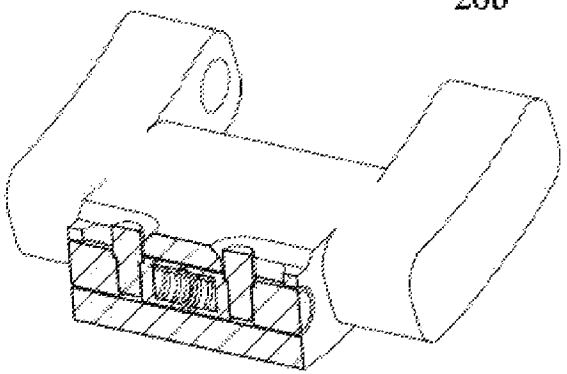
FIG. 7 is a further partially sectioned view of the link member of FIG. 5 with the control pins in the unlocked position.

As shown in FIGS. 6 and 7, when the locking mechanism 22 is duly assembled in the link 12*a*, the control pins 24*a*, 24*b* extend through the respective openings 32*a*, 32*b* and may thus be operable to move the locking pins 26*a*, 26*b*. More particularly, the control pins 24*a*, 24*b* may be moved between the positions shown in FIG. 6 (the "locking positions") and the positions shown in FIG. 7 (the "unlocked positions"). When the control pins 24*a*, 24*b* are moved away from each other to the positions as shown in FIG. 6, a longitudinal end of the locking pin 26*a* extends beyond one longitudinal end of the through hole 30, and a longitudinal end of the locking pin 26*b* extends beyond an opposite longitudinal end of the through hole 30. When the control pins 24*a*, 24*b* are moved towards each other to the positions as shown in FIG. 7, a longitudinal end of the locking pin 26*a* is flush with one longitudinal end of the through hole 30 or within the through hole 30, and a longitudinal end of the locking pin 26*b* is flush with an opposite longitudinal end of the through hole 30, or within the through hole 30. The spring 28 biases the locking pins 26*a*, 26*b* away from each other to the positions shown in FIG. 6, thus biasing the control pins 24*a*, 24*b* towards the locking positions. It can be seen that when the control pins 24*a*, 24*b* are moved between their locking positions and unlocked positions, the two control pins 24*a*, 24*b* move in opposite directions, and the two locking pins 26*a*, 26*b* also move in opposite directions. In addition, the locking pins 26*a*, 26*b* always move along a same straight line.

Figure 9:
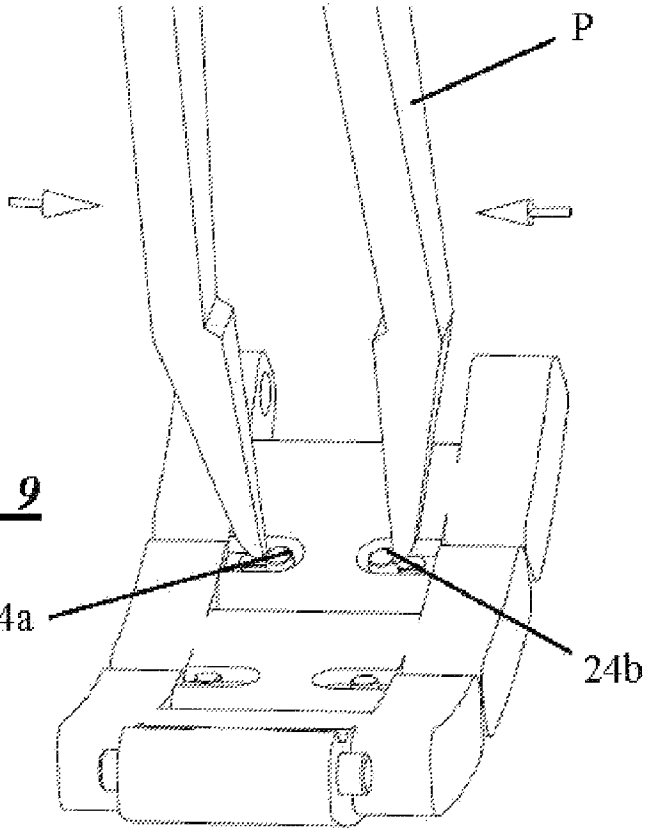
FIGS. 8 and 9 show steps of manipulating the control pins of the link member to allow detachment of the link member from the remaining link assembly.
Figure 8:
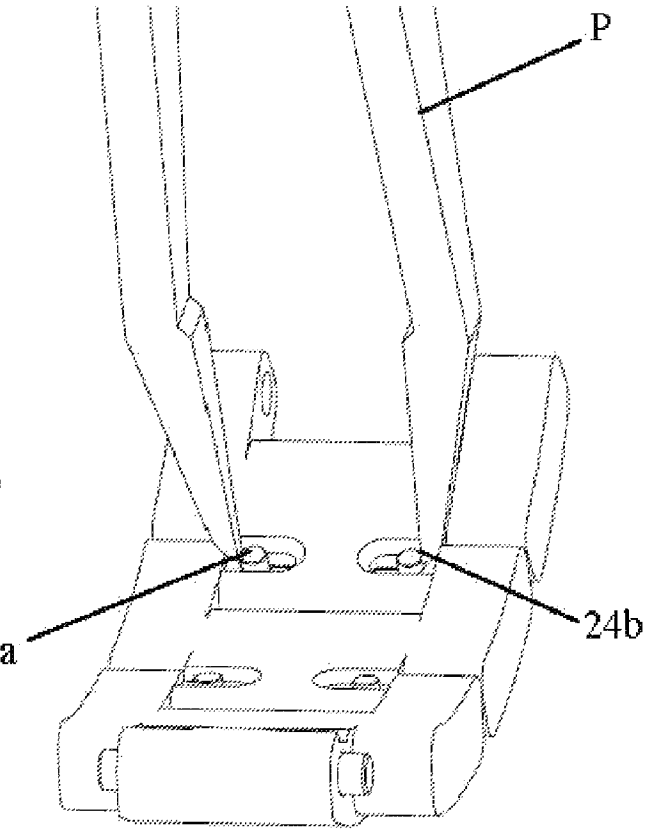

As shown in FIGS. 8 and 9, a pair of pliers P may be used for contacting and moving the control pins 24*a*, 24*b* between the locking positions and unlocked positions, so as to move the locking pins 26*a*, 26*b* simultaneously between the positions shown in FIG. 6 and those shown in FIG. 9.

Returning to FIGS. 1 to 4, it can be seen that, in FIG. 1, the control pins 24*a*, 24*b* of the link 12*a* are in the locking positions, in which the locking pins 26*a*, 26*b* are received partly within a respective hole 20*b* of the link 12*b* (of which only one is shown in FIGS. 3 and 4), so as to engage the link 12*a* with the link 12*b*, preventing disengagement of the link 12*a* from the link 12*b*. When the control pins 24*a*, 24*b* of the link 12*a* are moved (e.g. by a force) to the unlocked positions (as shown in FIG. 2), the locking pins 26*a*, 26*b* are clear of the holes 20*b* of the link 12*b*, such that the link 12*a* may be disengaged from the link 12*b* (as shown in FIG. 3). Upon release of the force acting on the control pins 24*a*, 24*b*, the control pins 24*a*, 24*b* will move, under the biasing force of the spring 28, to the positions shown in FIG. 4.

To then engage the link 12*a* with the link 12*b*, it is simply necessary to reverse the above steps, namely to move the control pins 24*a*, 24*b* (from the locking positions shown in FIG. 4) towards each other, against the biasing force of the spring 28, to the unlocked positions shown in FIG. 3. The link 12*a* is then moved towards the link 12*b* to a position where the through hole 30 of the link 12*a* is aligned with the holes 20*b* of the link 12*b* (as shown in FIG. 2). The force acting on the control pins 24*a*, 24*b* are then released, whereupon the locking pins 26*a*, 26*b* move away from each other (upon the biasing force of the spring 28) to extend into a respective hole 20*b* of the link 12*b*, to thereby releasably engage the link 12*a* with the link 12*b*. It can be seen that, when the link 12*a* is engaged with the link 12*b*, they are pivotable relative to each other about the locking pins 26*a*, 26*b*. Similarly, when the link 12*b* is engaged with the link 12*c*, they are pivotable relative to each other about the locking pins of the link 12*b*.

By way of such an arrangement, it is possible to allow an end user to easily remove at least one link from the link assembly 10 (to thereby shorten the link assembly 10), add at least one link to the link assembly 10 (to thereby lengthen the link assembly 10), or interchange the positioning of at least two links in the link assembly 10. In addition, as only the control pins 24*a*, 24*b* and openings 32*a*, 32*b* of the locking mechanism 22 can be seen from the outside, and only on the inner major surfaces 14*a*, 14*b*, 14*c*, when the link assembly 10 (and any bracelet and wearable article incorporating such the link assembly 10) is worn by a user, there is no compromise to the outward appearance of the link assembly 10, bracelet and wearable article.

Although FIGS. 1 to 9 show a link assembly formed of up to three link members, it is of course evident that the link assembly may be formed of a different number of link members.

It is envisaged that an endless bracelet may be formed of the link assembly, either of itself only or with other elements (e.g. such as an ornamental or jewelry item), thus allowing the length of the bracelet to be easily adjusted by an end user. In addition, such a bracelet may form a watch strap of a wristwatch, thus allowing the wearer to adjust the length of the watch strap.

It should be understood that the above only illustrates an example whereby the present invention may be carried out, and that various modifications and/or alterations may be made thereto without departing from the spirit of the invention. It should also be understood that various features of the invention which are, for brevity, described here in the context of a single embodiment, may also be provided separately or in any appropriate sub-combinations.

The invention claimed is:

1. A link assembly comprising:

a first link member with a first major surface and an opposite second major surface, and a second link member releasably engageable with said first link member, wherein said first link member includes at least a first locking member and a second locking member and at least a first control member and a second control member, wherein the first locking member and the first control member are movable simultaneously with each other, wherein the second locking member and the second control member are movable simultaneously with each other, wherein said second link member includes at least one hole and a second hole, wherein when said first link member is engaged with said second link member, each of said first control member and second control member is movable between a respective locking position and a respective unlocked position, wherein when said first control member and said second control member are in their respective locking position, at least part of said first locking member is received within said first hole of said second link member and at least part of said second locking member is received within said second hole of said second link member to prevent disengagement of said first link member from said second link member, wherein when said first control member and said second control member are in their respective unlocked position, said first locking member is clear of said first hole of said second link member and said second locking member is clear of said second hole of said second link member to allow disengagement of said first link member from said second link member, wherein each of said first control member and said second control member extends through a respective opening of said first major surface of said first link member, wherein a biasing element is positioned between said first locking member and said second locking member and biases said first locking member and said second locking member away from each other, and wherein, when said first link member and said second link member are engaged with each other, said first link member and said second link member are pivotable relative to each other about said locking members.

2. A link assembly according to claim 1 wherein said first control member and said second control member are biased towards their respective locking position.

3. A link assembly according to claim 1 wherein when said first control member is moved from its unlocked position to its locking position and when said second control member is moved from its unlocked position to its locking position, said first locking member and said second locking member move in substantially opposite directions.

4. A link assembly according to claim 1 wherein, when said first control member is moved between its unlocked position and its locking position and when said second control member is moved between its unlocked position and its locking position, said first locking member and said second locking member move on a same straight line.

5. A link assembly according to claim 1 wherein said first hole and said second hole face each other.

6. A link member according to claim 1 wherein said first link member and said second link member are substantially identically structured.

7. A link member according to claim 1 wherein said first locking member and said second locking member are biased by said biasing element towards their respective locking positions.

8. A link member according to claim 1 wherein when said first locking member and said second locking member are in their respective unlocked positions, a respective longitudinal end of said locking members is flush with a longitudinal end of a respective hole of said first link member or within a respective hole of said first link member.

9. A bracelet including a link assembly according to claim 1.

10. A bracelet according to claim 9 wherein said first major surface of said first link member is adapted to be in contact with a wearer of said bracelet.

11. A bracelet according to claim 9, further including a third link member, wherein said first link member, said second link member and said third link member are releasably engageable with one another.

12. A bracelet according to claim 11 wherein said first link member, said second link member and said third link member are substantially identically structured.

13. A wearable article including a bracelet according to claim 9.

14. A wearable article according to claim 13 wherein said wearable article is a wristwatch.

* * * * *